US007726027B2

(12) United States Patent
Fuks et al.

(10) Patent No.: US 7,726,027 B2
(45) Date of Patent: Jun. 1, 2010

(54) METHOD OF MANUFACTURING HOLLOW STRUCTURAL ELEMENTS

(75) Inventors: Leon Fuks, Angered (SE); Stefan Preijert, Göteborg (SE)

(73) Assignee: Volvo Lastvagnar AB, Gothenburg (SE)

( * ) Notice: Subject to any disclaimer, the term of this patent is extended or adjusted under 35 U.S.C. 154(b) by 1395 days.

(21) Appl. No.: 10/861,347

(22) Filed: Jun. 7, 2004

(65) Prior Publication Data

US 2005/0091825 A1 May 5, 2005

Related U.S. Application Data

(60) Provisional application No. 60/320,249, filed on Jun. 6, 2003.

(51) Int. Cl.
*B21D 53/88* (2006.01)
*F16H 57/02* (2006.01)

(52) U.S. Cl. ..... 29/897.2; 29/463; 29/430; 74/607; 72/365.2

(58) Field of Classification Search ..... 29/463, 29/897.2, 430; 74/607; 72/365.2
See application file for complete search history.

(56) References Cited

U.S. PATENT DOCUMENTS

| | | | | | |
|---|---|---|---|---|---|
| 447,077 | A | * | 2/1891 | Middleton | 403/43 |
| 1,350,829 | A | * | 8/1920 | Murray | 29/414 |
| 1,440,658 | A | * | 1/1923 | Coapman | 29/463 |
| 1,451,401 | A | * | 4/1923 | Murray et. al. | 74/607 |
| 1,492,930 | A | * | 5/1924 | Murray, Jr. | 74/607 |
| 1,613,592 | A | * | 1/1927 | Smith | 74/607 |
| 1,620,616 | A | * | 3/1927 | Lambert | 72/341 |
| 1,643,225 | A | * | 9/1927 | Smith | 29/463 |
| 1,709,185 | A | * | 4/1929 | Murray, Jr. | 29/463 |
| 1,715,135 | A | * | 5/1929 | Lambert | 72/294 |
| 1,940,305 | A | * | 12/1933 | Kapitke et. al. | 29/463 |
| 2,069,480 | A | * | 2/1937 | Riemenschneider et al. | 74/607 |

(Continued)

FOREIGN PATENT DOCUMENTS

EP 0015648 A1 9/1980

(Continued)

OTHER PUBLICATIONS

International Search Report PCT/SE2004/000429 in co-pending U.S. Appl. No. 11/164,802.

*Primary Examiner*—Essama Omgba
(74) *Attorney, Agent, or Firm*—Novak Druce + Quigg LLP

(57) ABSTRACT

The invention relates to a method for manufacturing a hollow, elongated structural element, where a first and a second blank (1, 14) are led through an oven (2) for heating to working temperature and are led through rollers (3, 4) with profiled surfaces for pre-forming in one or more steps. The blanks are each led through a forging press with a number of cooperating dies, the blank being worked in a number of steps (5, 8, 11) into halves of an essentially finished product, having a cross-section substantially in the shape of a U-profile with a predetermined varying height, width and thickness of material along its length. The second blank (14) is essentially a copy of the first blank (1). In a final step (15) the blanks are joined together into a composite hollow structural element (18). The invention also relates to a structural element manufactured according to the method.

11 Claims, 5 Drawing Sheets

U.S. PATENT DOCUMENTS

| | | | | | |
|---|---|---|---|---|---|
| 2,674,783 | A | * | 4/1954 | Schneider et. al. | 228/173.6 |
| 3,015,238 | A | * | 1/1962 | Williams | 74/607 |
| 3,213,531 | A | * | 10/1965 | Wylie | 29/463 |
| 3,673,888 | A | * | 7/1972 | Moll et al. | 74/607 |
| 3,793,703 | A | * | 2/1974 | Winkler et al. | 29/463 |
| 3,893,601 | A | * | 7/1975 | Winslow | 222/566 |
| 4,674,594 | A | * | 6/1987 | Jensen | 181/243 |
| 4,756,466 | A | * | 7/1988 | Peck | 228/165 |
| 4,760,755 | A | * | 8/1988 | Peck | 74/606 R |
| 4,841,802 | A | * | 6/1989 | Peck | 74/607 |
| 4,921,159 | A | * | 5/1990 | Peck | 228/182 |
| 5,469,618 | A | * | 11/1995 | LeMonds et al. | 29/889.72 |
| 5,934,544 | A | | 8/1999 | Lee et al. | |
| 6,122,948 | A | | 9/2000 | Moses | |
| 6,609,649 | B1 | * | 8/2003 | Barnholt et al. | 228/171 |
| 7,461,454 | B2 | * | 12/2008 | Melton et al. | 29/897.2 |
| 2004/0123462 | A1 | * | 7/2004 | Preijert et al. | 29/897.2 |
| 2006/0242835 | A1 | * | 11/2006 | Fuks et al. | 29/897.2 |

FOREIGN PATENT DOCUMENTS

| | | | |
|---|---|---|---|
| EP | 0059038 | A2 | 9/1982 |
| JP | 11-011105 | A | 1/1999 |
| SE | 516792 | C2 | 3/2002 |

* cited by examiner

METHOD OF MANUFACTURING HOLLOW STRUCTURAL ELEMENTS

TECHNICAL FIELD

The invention relates to a method of manufacturing hollow composite structural elements, preferably designed for use in vehicles.

BACKGROUND ART

Many fields today require weight-optimized products without sacrificing function or strength. This is particularly true of forged products, which can be heavy and difficult to optimize due to limitations of the tools used for manufacture.

One example is front axle beams for heavy vehicles. These beams are typically forged as an I-profile, where the web or core in the beam cross-section has very little effect on the torsional rigidity. With strength calculations it can be shown that a tubular cross-section, with a material moved radially outwards as far as possible, is optimal for such a structure. This is particularly true of the so-called "swan neck" on the front axle beam, between its central portion and a king pin support. With conventional forging technology it is, however, difficult to achieve this. EP-A2-0 059 038 shows a front axle beam forged lying in a conventional manner, i.e. the blank lies with its final vertical plane (after mounting) in the horizontal plane during working. The specification describes how a blank is pre-shaped by means of rolling and is then moved between a number of presses, which forge the entire blank or portions thereof to the desired shape. The disadvantage of this method is, as was described above, that the web of the beam is largely located centrally, which has very little effect on the torsional rigidity.

An alternative solution is shown in EP-A1-0 015 648, which describes the forging of a rectangular hollow front axle beam, starting from a tubular blank. While it is true that it is possible to obtain a beam with higher torsional rigidity with this method, it involves a number of problems. To produce the tapered ends of the beam these must be pulled through a die. Even if the material is distributed radially further out from the centre of the beam, the possibility of controlling the thickness of the material is very limited. This also applies to the other parts of the beam, since the starting material is a tube with constant thickness. Quite some work is required on the ends of the beam to provide king pin supports and the mounting of separate mounts for air bellows, for example.

Another solution is revealed in U.S. Pat. No. 6,122,948, which shows a hydroformed front axle beam. In this case as well one starts from a tubular blank, which is first bent to the desired basic shape and is then hydroformed to its final shape. The disadvantage of this solution is firstly that, as in the example above, it is not possible to control the distribution of material along the length of the profile. One must also provide the profile with a number of separate mounts, not only for the air bellows but also for the king pins. The latter must be welded on, for example, which provides the beam with a natural weak point susceptible to corrosion.

Finally, it is also possible to cast hollow front axle beams as is shown in JP-A-11-011105. For reasons of casting technology, there are, however, limits as to the greatest and smallest thickness and requirements for reinforcing ribs, complicated casting cores and the like, to permit casting of such an advanced profile. Beyond this, there are additional limits as regards which materials are practically possible and the economic consequences on the piece price of the axle beams due to the great increase in costs which a casting process would involve.

Most of the above mentioned problems can be solved by the manufacturing method according to the invention. This method makes it much more possible to achieve exact control of the distribution of material around and along a forged profile.

DESCRIPTION OF THE INVENTION

The invention relates to a method of manufacturing a hollow, elongated structural element in accordance with claim 1 and its subclaims.

The method comprises the following steps:

a) a first blank is led through an oven for heating to working temperature, b) the first blank is led through a pair of rollers with profiled surfaces, the blank being preformed in one or more steps to an intermediate with a predetermined profile along its length, c) the first blank is placed in a forging press with a number of cooperating dies, the blank being worked in a plurality of steps to a first half of an essentially finished product, having a cross-section substantially in the shape of a U-profile with a predetermined varying height, width and thickness of material along its length, d) a second blank is led through an oven for heating to working temperature, e) the second blank is led between a pair of rollers with profiled surfaces, the blank being preformed in one or more steps to an intermediate with a predetermined profile along its length, f) the second blank is placed in a forging press with a number of cooperating dies, the blank being worked in a plurality of steps to a second half of an essentially finished product, having a cross-section substantially in the shape of a U-profile with a predetermined varying height, width and thickness of material along its length, the second blank being essentially a copy of the first blank, g) the first and the second blank are joined in a last step, at least along their respective edges, into a composite hollow structural element.

In contrast to known technology, the first and second blanks are forged horizontally; i.e. the horizontal dividing plane of the blank during processing coincides essentially with the vertical plane in which the construction element is intended to be mounted.

The starting material can, for example, be a round, square or rectangular blank, which is cut to the desired length and is then heated in an oven to a working temperature suitable to the material. When using air-tempered micro-alloyed steel, for example, the blank is heated to 1250-1300° C., preferably to 1280° C. In a first step, the blank is given a suitable cross-section with the aid of a pair of rotating rollers, which can be made profiled. The rolled blank is thereafter moved to a forging press for working to the final shape.

The forging operation includes a first step, where a pair of first cooperating dies shapes the material in the first blank so that it is provided with a predetermined, varying height in a vertical plane along its length. The blank is provided with its essential basic shape in this plane. The blank is thereafter moved to a new forging press or is worked by a new die, which carries out a second step where a pair of cooperating dies shapes the material in the first blank so that it is given a predetermined varying thickness along one or more of the side surfaces, bottom surface or upper edge surfaces of the profile along its length. This second step is repeated one or more times in additional forging presses or additional dies, the sequential dies shaping the blank until it has obtained its final shape. In this manner it is possible to redistribute the material in the blank, both cross-sectionally and along its length. By using suitable dies, the blank can be freely shaped as far as the forging process permits along both its inner and outer periphery.

To achieve a closed profile, the first blank must be joined to a second blank. The second blank is made of the same starting material as the first blank. The second blank is preformed and finally formed in the same manner as the first blank, in a separate forging operation in the same press or in a separate press, to essentially the same profile as the first blank relative to the dividing plane of the dies. A particularly advantageous embodiment is to make both of the blanks with identical profiles in the same press tool, with one blank being turned so that the edges of the blanks in the dividing plane can be placed against each other.

Before joining the first and second blanks into a common structural element, there is an additional heating of at least the outer edges of each blank. According to a preferred embodiment the joining is done by means of flash butt welding. Flash butt welding is a process intended to achieve a butt weld with the same strength as a corresponding forged blank. This is suitably done by securing the blanks in contact with each other and pressing them together in a controlled manner while a welding current is applied to melt the material in the joint between them.

According to an alternative embodiment, the joining together can be effected by heating the joint edges of the first and second blanks with an induction loop, whereafter they are placed between a pair of cooperating dies in a press and are joined by means of forge welding. Alternatively, the joint edges of the first and second blanks can be heated at the same time by a heating means inserted between the first and second blanks. The blanks are held between a pair of cooperating dies in a press and are thereafter joined together by forge welding. Said heating means can be induction elements, gas flames or the like.

In a final operation, flash is trimmed off along the joint edges of the profile. This can either be done in the same pressing operation where the first and second blanks are joined together, or by separate trimming of the outer edges of the joined profile. The profile is thereby provided along its length with a predetermined varying height, as seen in the plane in which the structural element is intended to be mounted.

The final result will be an elongated structural element with a hollow, closed cross-sectional profile. The element comprises a first part with a cross-section essentially in the shape of a U-profile which has a predetermined varying width, height and thickness of material along its length, and a second part which has an essentially identical U-profile. The two U-profiles are turned with their open portions facing each other and are joined together at least along their edge surfaces. The expressions "edge surfaces" or "joining surfaces" include all those surfaces where the U-profiles are in contact with each other at or near the dividing plane. Examples of such surfaces are the outer peripheral limiting surface of each profile, and other surfaces where the edge surfaces of a U-profile are joined to a surface, or where surfaces spaced from the edge surfaces are located at or near the dividing plane.

The joined U-profiles have an essentially vertical dividing plane with regard to the main plane in which the structural element is designed to be used. The edge surfaces of the U-profiles facing each other are essentially located in this plane. It is also possible to provide the respective edge surfaces with cooperating projections and cavities. Such projections and cavities contribute, firstly, to simplify the positioning of the U-profiles relative to each other when they are to be joined and, secondly, to the strength of the assembled structural element after joining.

The embodiments described above increase the possibilities of optimizing the thickness of material of the structural element over known technology. Firstly, the material can be distributed so that the greatest thickness is obtained where the loads on the structural element are greatest and, secondly, material is moved towards the periphery of the structural element which increases the torsional rigidity of the element. A hollow profile of this type also provides significant weight-savings over a corresponding product forged in a conventional manner.

In order to further increase strength, the structural element can be manufactured of air-hardening, micro-alloyed steel. Thus the product does not need to be tempered or heat-treated in any other manner after the two parts are joined together. It is, of course, possible to use steel of another quality but in that case, an additional cost-increasing heat treatment or other treatment may be necessary to achieve the desired strength.

A structural element which is suitable to manufacture in this manner is a front axle beam. By using the above method, it is possible to manufacture such a beam with 30% lower weight than a conventionally forged beam (see e.g. EP-A2-0 059 038 above).

As was mentioned above, it is possible to optimize the manufacturing method so that the greatest material thickness of the front axle beam occurs at the mounting points and the areas which are to be loaded with external forces and bending moment. The method also makes it possible to adapt the cross-section of the front axle beam in such a way that it is given essentially the same outer contours, in both the vertical and horizontal plane as a conventionally forged solid beam. By giving the outer contours of the beam the same shape and the same so-called "offset" (the vertical height of the king pin supports relative to the spring elements) and "drop" (the vertical vertical height of the upper midpoint of the beam relative to the mounting points of the spring elements) as a standard beam in a certain vehicle, it can be used without having to make any changes in existing vehicles. It is also possible to retain the existing mounting points and mechanical interfaces for wheel holders, springs and the like.

DESCRIPTION OF THE FIGURES

The invention will be described in more detail in the following description of a preferred embodiment, shown as an example with reference to the accompanying schematic drawings, of which.

PREFERRED EMBODIMENTS

Figure 1:
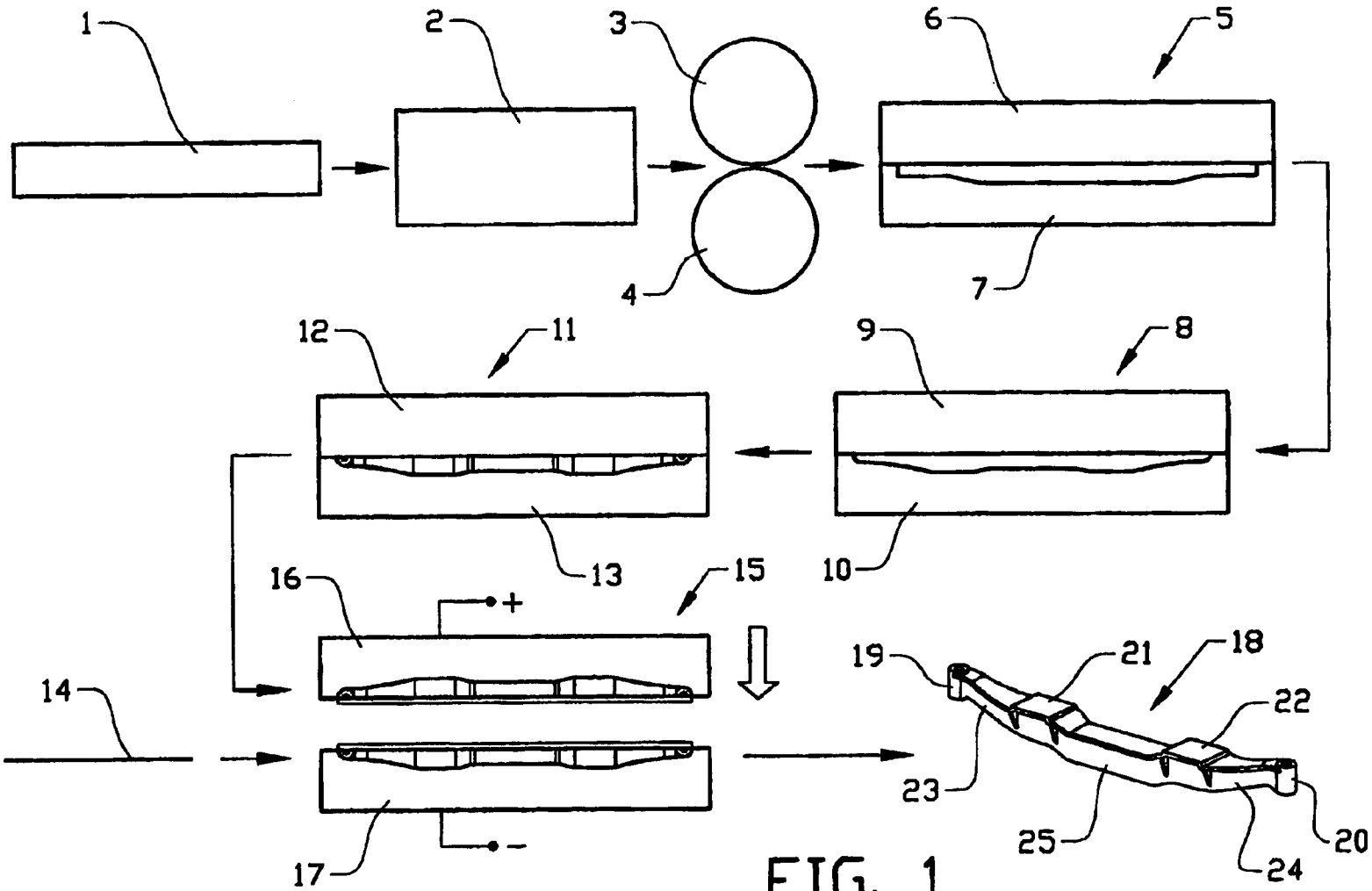
FIG. 1 shows a schematic representation of the steps encompassed by a preferred embodiment of the method according to the invention.

FIG. 1 shows a preferred embodiment of the method according to the invention, said method comprising a number of steps for manufacturing of a composite hollow structural element, in this case a front axle beam for heavy vehicles.

A first blank 1, which has been cut to a predetermined length, is led through an induction oven 2, where it is heated to working temperature. When using, for example, air-hardening micro-alloyed steel, the blank is heated to 1250-1300° C., preferably to 1280° C. When the correct temperature has been reached, the blank is led through a pair of profiled rollers 3, 4, which are profiled to impart a suitable starting cross-section to the blank 1 along its length. By suitable design of the respective profiles of the rollers 3, 4, an intermediate is obtained, the cross-section and material thickness of which vary along the length of the blank in a manner which at least partially corresponds to the finished product or a rough approximation of the final U-profile thereof. In this stage, the blank 1 is still essentially straight, at least along the peripheral edges, with a number of depressions along the central portion.

In the next step, the pre-shaped blank is moved to a first forging press 5 with upper and lower cooperating dies 6, 7. In this forging press 5, the shaping of the blank 1 is started, and its cross-section is given a more pronounced U-profile in certain predetermined areas where high torsional resistance is desired. Examples of such areas are the so-called swan necks 23, 24 at the outer ends of the front axle beam. These swan necks connect a pair of king pin supports 19, 20 with the central section 25 of the beam. In other areas, where high bending resistance is desired, the transverse ribs are retained between the opposing vertical sides of the profile. Examples of such areas are the mounting points 21, 22 for the spring elements (not shown) which are placed between the vehicle chassis and the front axle beam. Such spring elements can be, for example, air bellows. In addition to the shaping of the cross-section of the blank 1, there is also initiated a horizontal and vertical deformation to provide the beam with the desired width and vertical height, also called the drop, along its length. As seen in the dividing plane of the dies, this shaping gives the blank a varying height as measured in the vertical plane and a varying distance from a horizontal plane through the outer ends of the blank 1. Relative to said dividing plane, the greatest vertical height of the finished beam and the greatest distance from the horizontal plane coincide with the beam mountings for spring elements. The horizontal dividing plane of the dies will thus coincide with a vertical plane through a joined hollow front axle beam in the position in which the beam is intended to be used.

In the subsequent steps, the blank is moved to a second and a third forging press 8, 11 with respective upper and lower dies 9, 10; 12, 13. When the blank leaves the third forging press 11, it has been given its final shape and is ready to be joined together with a second blank 14 to a composite hollow beam.

The forging process above is described and illustrated, for the sake of clarity, as using a number of presses placed after each other. It is, of course, possible to shape the blanks in a single forging press, changing only the dies after each working step. The invention per se is not limited to any of these forging processes.

The number of steps required to obtain the desired shape of the blank can of course be varied within the scope of the invention, since the number is directly dependent on the properties of the starting material and the degree of deformation which is desired.

The second blank 14 can start from the same starting material as the first blank. The second blank can be pre-shaped and finally shaped in the same manner as the first blank 1 in a separate forging operation, and possibly in a separate press, into essentially the same profile as the first blank relative to the dividing plane of the dies.

According to a preferred embodiment, two identical blanks are manufactured, the first blank being turned to face the other so that their opposing edges are placed against each other during the joining operation. In this manner, the two blanks can be formed in the same press tool, which reduces the manufacturing cost.

In order to join the first and the second blanks 1, 14, they are led to a flash butt welding machine 15 with cooperating fixing plates or dies 16, 17, with the two blanks 1, 14 being positioned in their respective fixing plates 16, 17. Prior to working and joining, the first blank 1 and the second blank 14 must be brought into contact with each other along their respective edge surfaces.

The blanks are fixed into contact with each other and are then pressed together in a controlled manner while a welding current from a current source, such as a welding transformer, is applied to melt a controlled amount of material in the joint between the edges of the blanks. The molten material will be pressed out of the joint, and forms a flash, there being at the same time a corresponding reduction of the width of the blanks. This will be described in more detail in connection with FIGS. 4 and 5. In order for the composite structural element to be given the desired width, the edges of the blanks 1, 14 must therefore be forged to a somewhat larger dimension in a direction perpendicular to the divided plane of the dies. The flash can be removed immediately by cooperating tools in the fixing planes 16, 17, or in a subsequent step. Any oxides or other contaminants on the edge surfaces will be pressed out of the joint together with the molten steel during the process, which provides a homogeneous joint with the same strength and other properties as for the forged blanks. The result will be a composite elongated structural element in the form of a hollow front axle beam.

According to an alternative embodiment, it is also possible to heat the cooperating edges of the two blanks 1, 14 separately, before they are joined together by means of forge welding along all their surfaces where the first and second blanks are in contact with each other. The heating of the two blanks can also be effected with the aid of gas flames or the like. In connection with the forged welding together of the first and second blanks, trimming or removal of superfluous material (e.g. flash) around the edges of the workpiece can be carried out. According to an additional alternative embodiment, it is also possible to weld together the two blanks 1, 14.

When the front axle beam is finally welded together, there is a final machining phase where mounting holes are drilled for the spring elements and king pin supports are processed to their final shape and tolerance.

Figure 2:
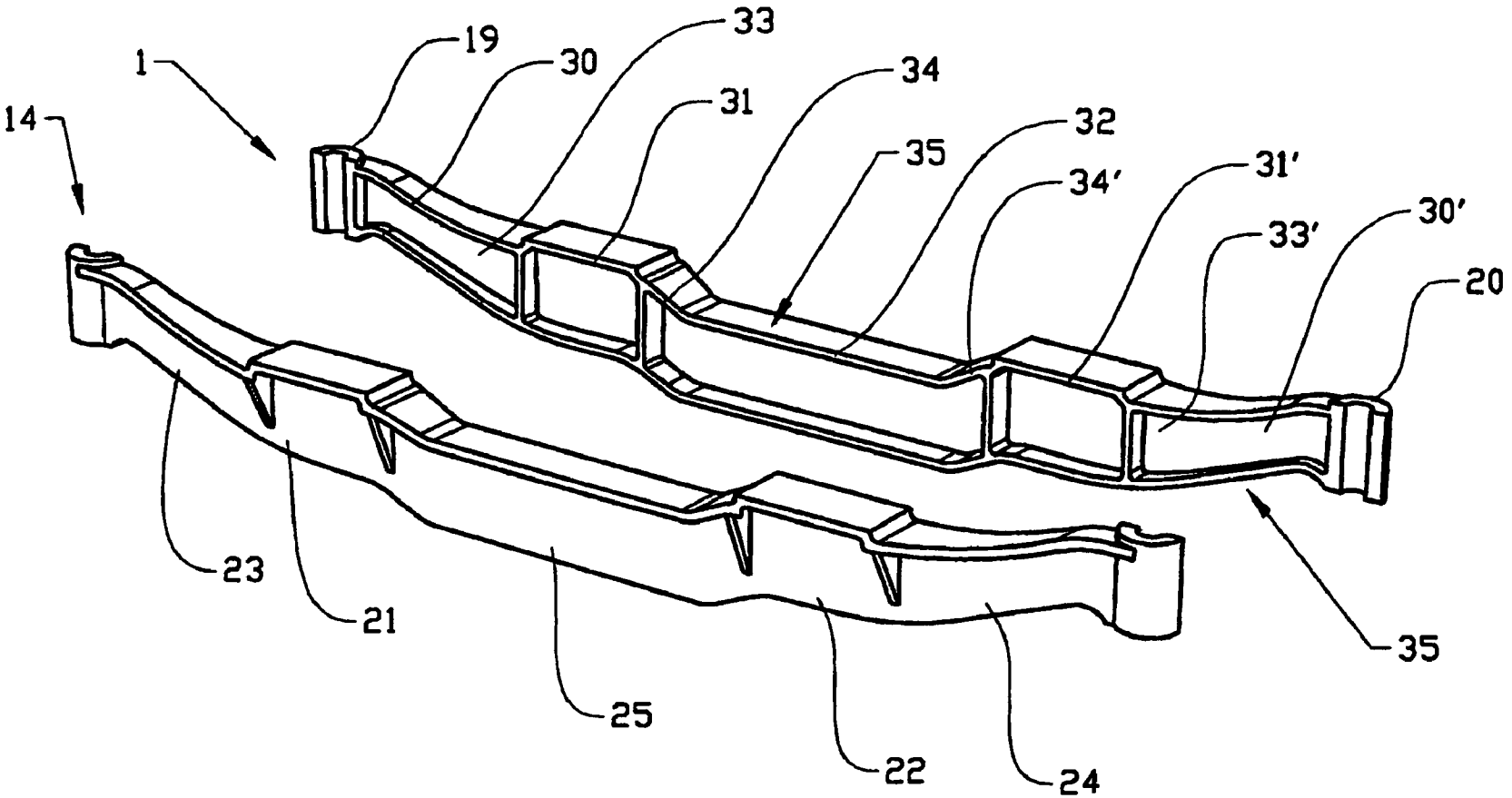
FIG. 2 shows a perspective view of two shaped blanks prior to final joining into a front axle beam according to a preferred embodiment.

FIG. 2 shows the first and second blanks 1, 14 as they appear after final shaping, when they are ready to be joined together. The Figure shows a view of the front axle beam from an angle obliquely from above, showing the varying horizontal and vertical dimensions along its length. The inner cavities 30, 30', 31, 31' and 32 of the first blank 1 and its transverse reinforcing ribs 33, 33', 34, 34', and its king pin supports 19, 20 can be clearly seen. The peripheral edge surfaces 35 of the first blank 1 have, in this embodiment, an essentially even thickness along most of their length, but it is of course also possible to vary their thickness along the longitudinal extent of the beam, e.g. by making them thicker in the areas which, after mounting in a vehicle, will be subjected to higher load.

This is suitably achieved in connection with the forging operations for the respective blank. The second blank 14 shows the outer contours of the front axle beam. The swan necks 23, 24 of the front axle beam are shown, which connect the respective king pin support 19, 20 with the central portion 25 of the beam.

Figure 3:
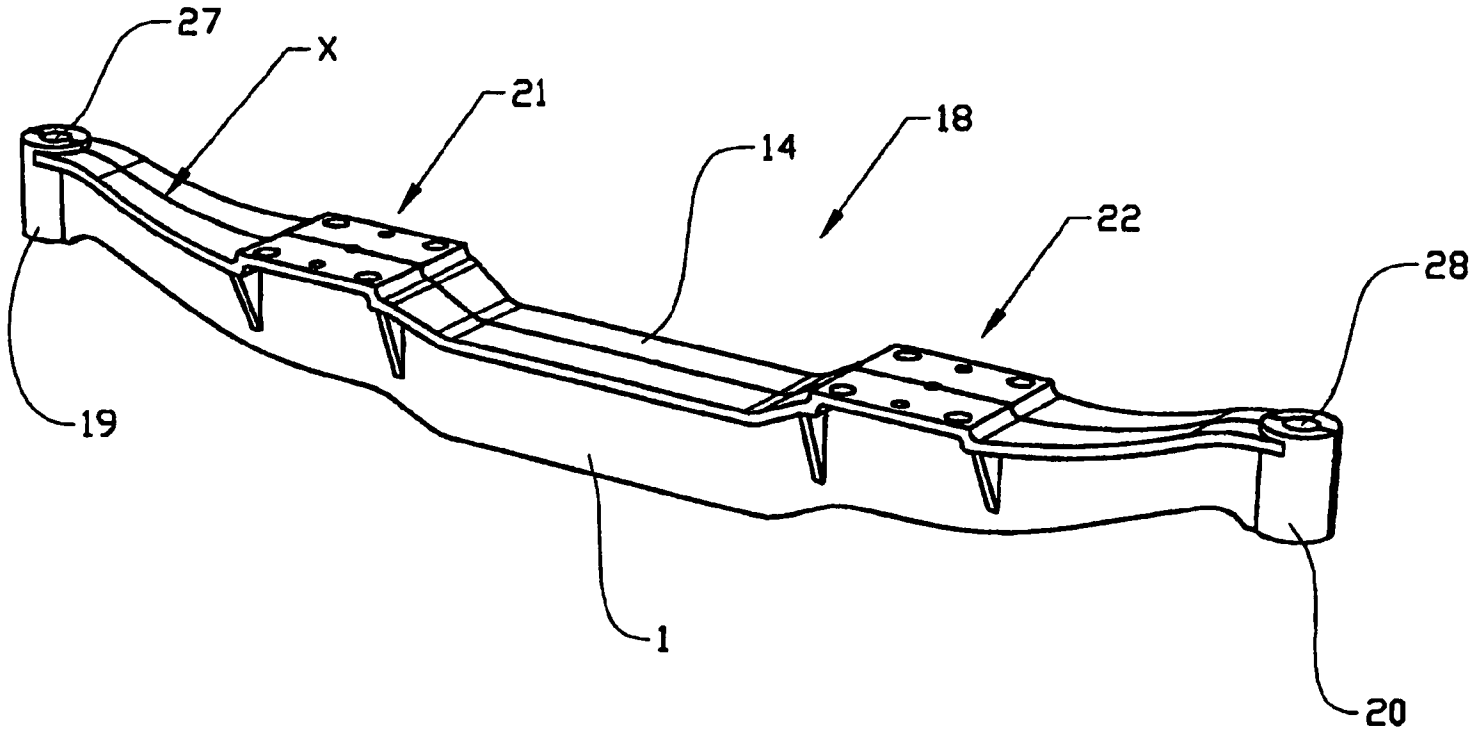
FIG. 3 shows a front axle beam comprising two blanks according to FIG. 2 after joining.

FIG. 3 shows a finished front axle beam, which has been trimmed to a predetermined width along its peripheral edge. The king pin supports 19, 20 have also been worked and provided with through-mounting holes 27, 28 for king pins, and holes have been drilled for fixing elements at mounting points 21, 22 for a pair of air bellows (not shown) between the front axle beam and the vehicle chassis.

This preferred embodiment shows a front axle beam composed of a pair of essentially symmetrical blanks 1, 14, the vertical dividing plane X of the front axle beam running along the joint in the middle of the front axle beam. The finished front axle beam will have the same outer dimensions as a conventionally forged front axle beam, and therefore it can be mounted in an existing vehicle without the necessity of making any further modifications in the vehicle.

Alternative embodiments with dividing planes which are displaced from the vertical plane of symmetry of the front axle beam are of course also possible.

Figure 4:
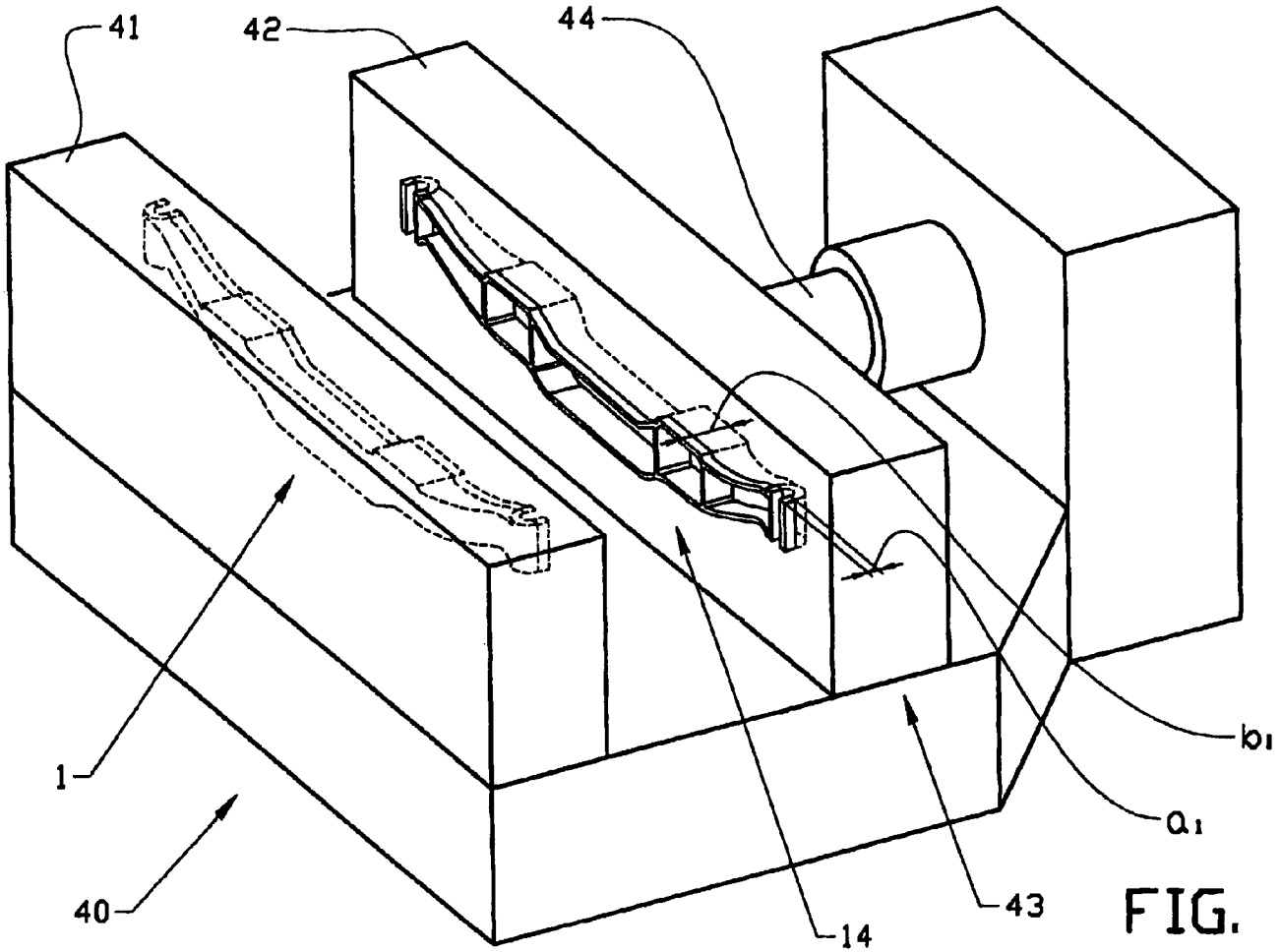
FIG. 4 illustrates a flash butt welding machine for welding two blanks into a front axle beam according to a preferred embodiment.

FIG. 4 illustrates schematically a flash butt welding machine 40 prior to joining of the first and second blanks 1, 14. The flash butt welding machine 40 has a first fixing plate 41 for the first blank 1 and a second fixing plate 42 for the second blank 14. The second fixing plate 42 is displaceable towards the fixed first fixing plate 41 along a guide 43. As indicated in the Figure, the respective blank has a predetermined projection $a_1$ from the front end surface of the respective fixing plate 41, 42. The displacement is achieved, preferably with a hydraulic cylinder 44, or alternatively with a corresponding mechanical means.

Figure 5:
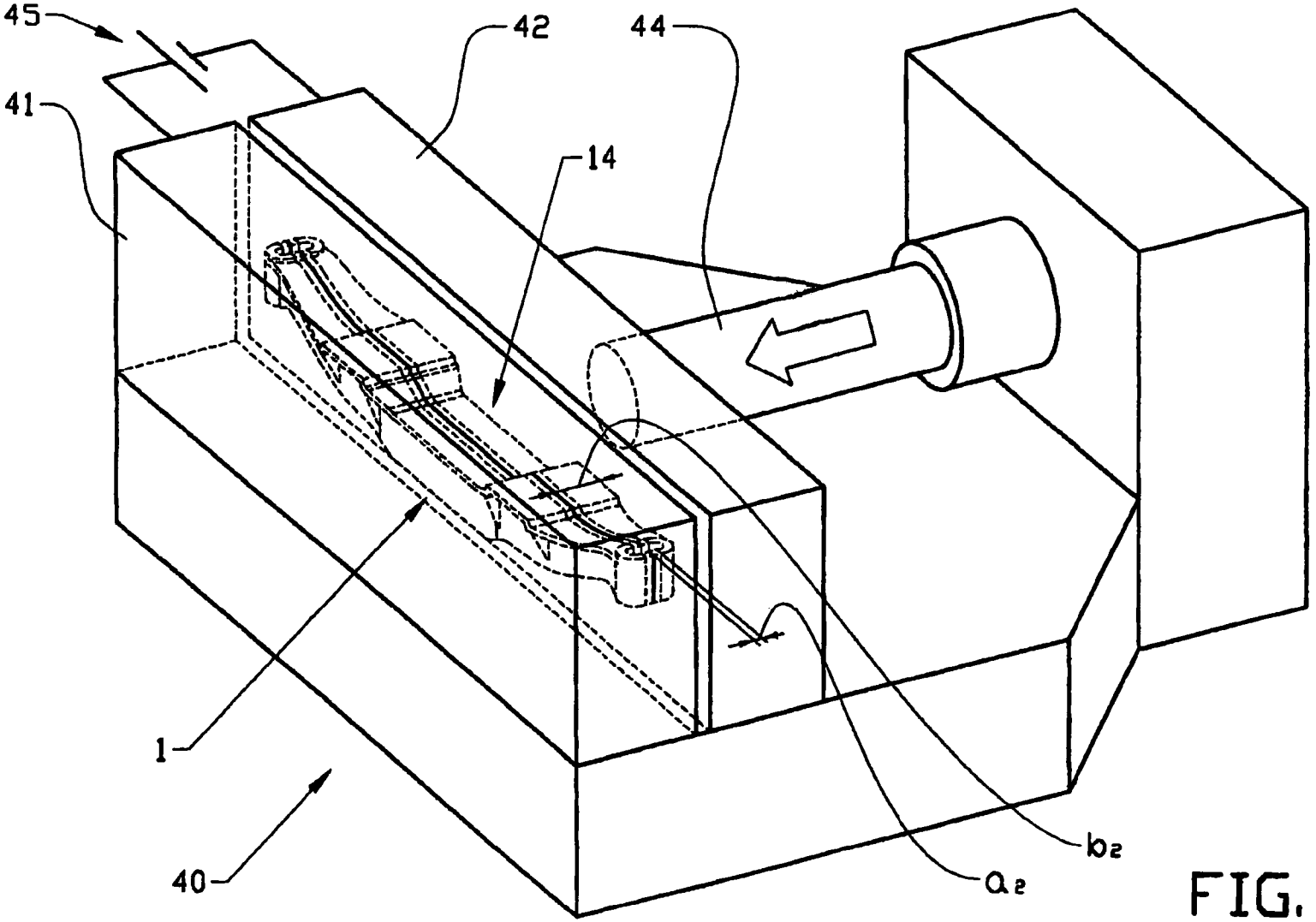
FIG. 5 illustrates a flash butt welding machine according to FIG. 4 after welding of a front axle beam.

FIG. 5 illustrates schematically how the first and second blanks 1, 14 are joined together in the flash butt welding machine 40. In a first step, the blanks are held in contact with each other by the second fixing plate 42 being displaced by the hydraulic cylinder 44. In this position, the distance between the facing surfaces of the fixing plates 41, 42 is adapted so that the width $b_1$ in the horizontal direction of the respective blank prior to joining together is somewhat greater than the corresponding width $b_2$ of the respective blank in the joined front axle beam. The two blanks 1, 14 are thereafter pressed together in a controlled manner with the aid of the cylinder at the same time as a welding current from a current source 45, such as a welding transformer, is applied to melt a predetermined amount of material in the joint therebetween. After the two blanks 1, 14 have been joined together, they have a reduced second projection $a_2$ and a corresponding, reduced width $b_2$. The portion of the edges which is heated to melting temperature corresponds to the distance in projection between said first projection $a_1$ and said second projection $a_2$. The reduction in the width of the blanks during joining means that the melted material will be pressed out of the joint, and forms a flash which can be removed directly by cooperating tools in the fixing plates 41, 42, or in a subsequent step.

The invention is not limited to the embodiments described above but can be applied to all types of structural elements which can be manufactured with the aid of the method described above.

The invention claimed is:

1. A method of manufacturing a hollow, elongated structural element constituting a front vehicle axle, said method comprising the following steps:

a) a first blank is led through an oven for heating to a working temperature, b) the first blank is led through a pair of rollers with profiled surfaces, the first blank being preformed in one or more steps to an intermediate shape with a predetermined profile along its length, c) the first blank is placed in a forging press with a number of cooperating dies, the first blank being worked therein in a plurality of die-forging steps to form a first, front half of the front vehicle axle, the first, front half so-produced including king pin bore-forming portions at ends thereof and having a cross-section substantially in the shape of a U-profile with a predetermined varying height, width, and thickness of material along its length, d) a second blank is led through an oven for heating to a working temperature, e) the second blank is led between said pair of rollers with profiled surfaces, the second blank being preformed in one or more steps to an intermediate shape with a predetermined profile along its length that is the same as the predetermined profile of said first blank formed in said step b), f) the second blank is placed in said forging press with cooperating dies, the second blank being worked therein in a plurality of die-forging steps to form a second, rear half of said front vehicle axle, the second, rear axle half so-produced including king pin bore-forming portions at ends thereof and being essentially identical to the first, front axle half, the front and rear axle halves each being symmetric about a vertical plane that passes through the lengthwise center point of the axle half such that right and left halves of each axle half, relative to the as-installed orientation of the axle halves, are symmetric, and g) the first, front axle half and the second, rear axle half are joined together, at least along their respective edges, to form said front vehicle axle with king pin bores at both ends thereof.

2. The method according to claim 1, wherein both the first and the second blank are each forged with their die dividing planes lying horizontally.

3. The method according to claim 1, wherein the die-forging operation comprises a first step where a pair of first cooperating dies forms the material in each of the blanks so that it has a predetermined varying height relative to a horizontal plane along its longitudinal direction, the blanks substantially receiving their basic shape in this plane.

4. The method according to claim 1, wherein the die-forging operation comprises a second step where a pair of second cooperating dies shapes the material in each of the blanks so that it receives a predetermined varying thickness along one or more of the lateral surfaces, bottom surface, and upper edge surfaces of the profile along its length.

5. The method according to claim 4, wherein the second step of the die-forging operation is repeated one or more times in subsequent dies until the blanks have obtained their final shape.

6. The method according to claim 1, wherein the first and the second axle halves are joined by means of flash butt welding.

7. The method according to claim 1, wherein the first and the second axle halves are each heated in an induction oven, whereafter they are placed between a pair of cooperating dies in a press and are joined together by means of forge welding.

8. The method according to claim 7, wherein the heating is effected with the aid of induction elements or a gas flame.

9. The method according to claim 1, wherein the first and the second axle halves are heated at the same time with the aid of heating means, which are inserted between the first and second axle halves, said axle halves being held between a pair of cooperating dies in a press, whereafter they are joined by means of forge welding.

10. The method according to claim 1, wherein trimming of flash along the joined edges of the first and second axle halves is done in the same operation as the joining of the first and second axle halves, whereupon the profile of the front vehicle axle obtains a final predetermined varying height along its length.

11. The method of claim 1, wherein in said steps c) and f) the blanks are worked in said plurality of die-forging steps so as to include transverse reinforcing ribs.

* * * * *